United States Patent [19]

Wenzel et al.

[11] 4,002,435

[45] Jan. 11, 1977

[54] CLEAR AND STABLE LIQUID FUEL COMPOSITIONS FOR INTERNAL COMBUSTION ENGINES

[76] Inventors: Edward C. Wenzel, 553 W. Shore Trail; Henry W. Steinmann, 13 Heighwood Trail, both of Sparta, N.J. 07871

[22] Filed: June 30, 1975

[21] Appl. No.: 592,083

Related U.S. Application Data

[63] Continuation-in-part of Ser. No. 199,773, Nov. 17, 1971, abandoned, which is a continuation-in-part of Ser. No. 84,507, Oct. 27, 1970, abandoned, which is a continuation-in-part of Ser. No. 56,746, July 20, 1970, abandoned.

[52] U.S. Cl. ..... 44/51; 44/53

[51] Int. Cl.[2] ..... C10L 1/32

[58] Field of Search ..... 44/51, 53

[56] References Cited

UNITED STATES PATENTS

| | | | |
|---|---|---|---|
| 2,111,100 | 3/1938 | Kokatnur | 44/51 |
| 3,490,237 | 1/1970 | Lissant | 44/51 |
| 3,527,581 | 9/1970 | Brownawell et al. | 44/51 |

*Primary Examiner*—Allen B. Curtis
*Assistant Examiner*—Y. Harris-Smith
*Attorney, Agent, or Firm*—Brumbaugh, Graves, Donohue & Raymond

[57] ABSTRACT

For use in internal combustion engines, a liquid fuel composition comprising a water-in-oil emulsion of hydrocarbons, water, a water-soluble alcohol, and a novel combination of surface-active agents to provide a clear fuel which is stable against phase separation over a wide range of temperatures.

6 Claims, No Drawings

CLEAR AND STABLE LIQUID FUEL COMPOSITIONS FOR INTERNAL COMBUSTION ENGINES

This application is a continuation-in-part of our patent application Ser. No. 199,773, filed Nov. 17, 1971, now abandoned which application is a continuation-in-part of our patent application Ser. No. 84,507, filed Oct. 27, 1970, now abandoned, which was, in turn, a continuation-in-part of our patent application Ser. No. 56,746, filed July 20, 1970, now also abandoned.

This invention relates to clear and stable fuel compositions for internal combustion engines. More particularly, this invention relates to the preparation of clear and stable liquid fuel compositions comprising (a) a mixture of hydrocarbons, such as gasoline (b) water, (c) a water-soluble alcohol, such as methanol, and (d) a combination of surface-active agents. These clear fuel compositions are basically water-in-oil emulsions which have excellent stability and viscosity over a wide range of temperatures, including temperatures below the freezing point of water. The liquid fuel compositions, according to the invention, will further maintain their clarity and low viscosity characteristics without phase separation. Thus, the compositions, according to the invention, are most efficiently utilized in operating the internal combustion engine.

An important objective of this invention is to provide a fuel for the internal combustion engine which results in significant decreases of toxic exhaust gases or vapors without sacrificing engine performance or efficiency. A second objective is to provide a fuel that is free from lead compounds, such as lead tetraethyl, and still obtains anti-knock characteristics, resulting in smooth engine performance. A third objective is to provide a fuel for the internal combustion engine wherein the percentage of hydrocarbons is substantially reduced, thereby better conserving energy derived from petroleum and partly replacing it with energy having reproducible sources. A still further objective of this invention is to provide clear liquid fuel compositions that are stable and usable, both under moderate and extreme weather conditions.

The term "water-in-oil emulsion," hereinafter referred to as "W/O emulsion," is a general term well-known to those skilled in emulsion technology. The term W/O emulsion, as used in the context of this invention, is believed to best describe the physical make-up of the novel fuel composition which we have obtained. It must be appreciated that we have achieved, through a unique surfactant blend, a clear and stable liquid fuel which, while an emulsion, exhibits desired single-phase properties of hydrocarbon fuels alone. As an emulsion, however, the liquid fuel of the invention is believed to contain the hydrocarbon mixture as the continuous "oil" phase and water and the water-soluble components as the dispersed "water" phase. Upon blending the various components of the liquid fuel, including the surfactant mixture, the resulting fuel composition is, for the purposes intended, a single-phase composition.

The oil phase of the fuel composition, according to the invention, comprises a mixture of hydrocarbons, such as that derived from petroleum, an example being that having the common name of gasoline. In the spirit of this invention, the oil phase is not confined to a specific mixture of hydrocarbons, but embraces a broad range of mixtures of hydrocarbons under the general classification of hydrocarbon fuels. Such hydrocarbon fuels will have varying viscosities and flash points, but all have the common characteristic of combustibility providing heat and energy which can be transformed into work.

The basis of the invention is the development of a liquid fuel containing water, which is introduced into the fuel system in a most effective manner. It is well-known that water or steam may be injected, as a separate phase, into internal combustion engines with the purpose of lowering the reaction temperature to retard the combustion rate and improve the anti-knock characteristics. Such injection methods are not only difficult to design and control, but introduce the water as an outside phase, which not only is ineffective in smoothly retarding the rate of combustion, but also can quench the combustion, resulting in an incomplete burn. We have now discovered that, when the water is intimately mixed with the fuel, substantially complete combustion occurs with the water performing the important role of smoothly retarding the rate of combustion, resulting in anti-knock performance. This important discovery means that anti-knock agents, such as lead tetraethyl, can be eliminated in such a fuel system which not only results in cleaner engine performance, but, even more important, results in the elimination of lead compounds in the exhaust fumes, thereby abating pollution. We have further discovered that the fuel composition, according to the invention, not only gives smooth engine performance without the need for the conventional anti-knock agents, but, more important, gives much lower carbon monoxide, oxides of nitrogen, and hydrocarbon content in the exhaust gases as compared to conventional fuels not containing water.

We have discovered that, when a particular combination of surface-active agents is added to a hydrocarbon fuel, such as gasoline, which is then combined with a solution of a water-soluble alcohol and water, a hydrocarbon-rich W/O emulsion, having the clarity and stability of a single-phase hydrocarbon fuel, readily forms with minimum agitation. Moreover, the clear fuel composition, according to the invention, has a viscosity similar to that of a hydrocarbon fuel itself. It has been found that the liquid fuel composition obtained is stable against phase separation by addition of amounts of water or gasoline, which do not affect the surfactant concentration. Moreover, we have discovered that there is no "vapor lock" when our liquid fuel is used in conventional carburetor systems.

Accordingly, our invention is the discovery of certain combinations of surface-active agents which will bring both the alcohol, water, and water-soluble constituents of the fuel into complete phase with the hydrocarbon constituent, resulting in a clear, stable liquid fuel for the internal combustion engine. Once this clear phase is formed, it is no longer sensitive to the addition of small amounts of water and alcohol, or to additional amounts of gasoline. The clear, stable liquid fuel containing the water, water-soluble alcohol, and surface-active agents has a low viscosity, like the hydrocarbon fuel itself, thereby making it easy for transport and utilization in conventional carburetor systems. It is also important that the surface-active agents themselves are organic compounds and, therefore, combustible to carbon dioxide and water, which still further provide energy. The surface-active agents also tend to broaden the temperature-time combustion profile because of their very high flash points.

The surface-active agents, according to the invention, are virtually non-toxic in that they do not contain harmful materials, such as sulfur, phosphorous, and halogens. While certain surface-active agents comtemplated do contain a small amount of nitrogen, the amounts present are insignificant, particularly when compared to the amount of nitrogen introduced by the air required for combustion.

The unique and novel combination of surface-active agents of the invention comprises an ammonium long-chain fatty acid salt, or, more preferably, a mixture of ammonium and sodium long-chain fatty acid salts, an unsaturated acid, and an ethylene oxide condensation product. The most preferred embodiment includes a mixture of ammonium and sodium oleate, free oleic acid, and the condensation product of an alkyl phenol with ethylene oxide. This combination of surface-active agents, when added to the hydrocarbon fuel, water, and alcohol constituents, provides a clear, stable liquid fuel composition.

Although oleic acid is most preferred as the free acid, other unsaturated acids, such as linoleic, may be used. Also, saturated long-chain fatty acids, such as stearic, can be used in combination with the unsaturated acids.

In addition to the condensation product of an alkyl phenol with ethylene oxide, other condensation products can be used. These products may be listed as follows.

1. Reaction products of ethylene oxide with alkyl phenols having the formula

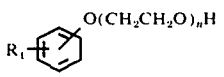

where $R_1$ is an alkyl chain having up to eight carbon atoms, such as n-butyl, isooctyl, and the like; and n is an integer which can vary between wide limits, such as 5 to 20, and whose value determines the degree of hydrophilic character of the surface-active agent.

2. Reaction products obtained by the condensation with ethylene oxide of fatty acids of the formula $$R_2-\underset{\underset{O}{\|}}{C}-(O-CH_2-CH_2)_nOH$$

and fatty alcohols of the formula $$R_2-(O-CH_2-CH_2)_nOH$$

where $R_2$ is a long-chain, saturated or unsaturated hydrocarbon radical, such as stearyl, cetyl, lauryl, oleyl, linoleyl, and the like; and n is an integer which can vary between wide limits, such as 5 to 20, and whose value determines the degree of hydrophilic character of the surface-active agent.

3. Reaction products of a polyol with long-chain, saturated or unsaturated fatty acids having the formula $$HOCH_2-(CHOH)_n-CH_2O\underset{\underset{O}{\|}}{C}-R_3$$

Where $R_3$ is a long-chain saturated or unsaturated hydrocarbon radical, such as stearyl, oleyl, and the like; and $n$ is an integer having a value usually between 1 and 4.

It was discovered that, when the ammonium and sodium salts of oleic acid were used without the aforementioned condensation products, we could not obtain a stable fuel composition containing water, a water-soluble alcohol, and a mixture of hydrocarbons. Phase separation occurred on cooling the fuel composition below the freezing point of water. It was also found that, if the condensation products were used without the ammonium and/or mixture of ammonium and sodium salts of oleic acid, a stable, clear, single-phase liquid containing water, a water-soluble alcohol, and a mixture of hydrocarbons could not even be formed at room temperature, that is, phase separation into two phases always occurred. But, when we used a combination of the ammonium and/or mixture of ammonium and sodium salts of oleic acid and the condensation product of ethylene oxide and an alkyl phenol, liquid fuel compositions, stable and clear above and below the freezing point of water, were obtained from the addition of this combination of surface-active agents to the mixture of hydrocarbons.

The water and water-soluble alcohol constituents of the fuel composition, according to the invention, provide many advantages. The invention resides in a novel combination of elements which bring the water and alcohol into intimate contact with the fuel hydrocarbons, such as gasoline, resulting in a liquid composition which is not only clear, but also stable, over the operative temperature range of the internal combustion engine. The purpose of the water in the fuel is to provide a lower temperature and broader temperature-time profiled during the combustion of the fuel. This results in lower emissions of oxides of nitrogen and carbon monoxide in the exhaust gases, thereby abating air pollution. The broader temperature-time profile results in smooth engine performance. It is believed that the water sufficiently retards the initial phase of the combustion, thereby imparting anti-knock characteristics to the fuel.

The purpose of the water-soluble alcohol, such as methanol, is to provide anti-freeze characteristics to the fuel, thereby resulting in a liquid fuel stable below the freezing point of water. A second purpose of the alcohol is an energy source partly replacing the petroleum-derived hydrocarbons. A third purpose of the alcohol is that it also contributes anti-knock characteristics to the fuel, resulting in improved engine performance.

Although we prefer methanol, the other water-soluble alcohols, such as ethanol, isopropanol, and mixtures of these, can be used for this invention.

The percentage of water by weight in the composition should range from about 0.1 to 10% and preferably ranges from 0.5 to 5%. A range of 0.1 to 20% alcohol by weight may be used, preferably 1 to 10%. While the amount of surface-active agents required must depend on the amounts of water and alcohol used in the fuel compositions, it is generally preferred that the ratio of the condensation products to the ammonium and/or mixture of ammonium and sodium salts of the saturated or unsaturated long-chain fatty acids be in the range of 1:1 to 3:1 by weight. The presence of the sodium salt of the long-chain fatty acid is not necessary to obtain clear, stable liquid fuel compositions in a single phase. This can be accomplished with just the ammonium salt in combination with the aforementioned condensation products. However, the presence of a sodium ion, in addition to an ammonium ion, in the composition is alkaline because it will result in a more desirable pH of the system, that is, a pH slightly on the alkalne side. The advantage of this is that the sodium salt of the long-chain fatty acid can react with acids stronger than the fatty acid, thereby neutralizing them. The result is not only less corrosive materials in contact with the engine parts and exhaust system, but, even more important, less toxic materials in the exhaust gases and vapors. The following factors illustrate the importance of using combined ammonium and sodium salts.

1. Any organic bromides or chlorides that may be present in gasoline as additives normally will generate hydrobromic or hydrochloric acids during combustion. Even small amounts of these additives are corrosive and irritating. However, if our fuel composition is used, the stable sodium chloride and sodium bromide would be formed, which are much less corrosive and both non-toxic and non-irritating.

2. Oxides of nitrogen in the presence of water vapor can be partially neutralized to form the more stable and less toxic and less irritating sodium salts.

3. Organic sulfur compounds which may be present in gasoline generate sulfur dioxide on combustion. With the high exhaust temperature, and especially in the presence of catalysts, such as contained in catalytic devices, oxidation to the toxic and very irritating sulfur trioxide, and subsequent entrainment of sulfuric acid in the exhaust gases and vapors, results. The presence of a sodium ion results in the more stable sodium sulfite compared to $SO_2$ or $H_2SO_3$, and there may be less tendency for the sulfur dioxide to be oxidized to sulfur trioxide by the catalytic converter. Even if the sulfur dioxide is oxidized to a partial extent forming sulfur trioxide, the resulting sulfuric acid would be neutralized, even at the high temperature, resulting in the non-toxic and non-irritating water-soluble sodium sulfate.

The preferred molar ratio of the ammonium to the sodium salt of the long-chain fatty acid is in the range from 95:5 to 50:50. It should also be recognized that the sodium ion can be introduced as the sodium salt of a short-chain fatty acid, such as sodium acetate. Since our fuel compositions contain water, the very water-soluble sodium acetate will be solubilized in the system. But, it is easier to use the sodium salt of the long-chain fatty acids because the resultant fuel compositions tend to be more stable.

An important advantage in using the combination of surface-active agents, according to the invention, is that high-shear mixing is not required. The ingredients of the fuel composition readily blend into a single phase by gentle hand stirring. This means that such fuel compositions can be readily prepared at the manufacturing site or, if preferred, prepared at the stations where the gasoline can be blended with the other constituents by simply metering the proper amounts of each constituent from storage tanks into a common mixing line.

The liquid fuel compositions of the invention can be utilized in conventional internal combustion engines without any change or modification in engine design. They can be used at low compression ratios, such as 8 to 1, or at high compression ratios, such as 10 to 1. Engine tests conducted with these fuel compositions show better performance at the more efficient high compression ratios. This is significant regarding the more efficient utilization of fuel and better conserving of our energy resources. Moreover, our fuel compositions can contain a high percentage of the highly volatile methanol and still be utilized in conventional carburetor systems without vapor lock occurring.

There are several ways in which the components can be combined to form a suitable fuel composition. Most of the surface-active agents can first be added to the hydrocarbon phase and a small amount in the aqueous phase, and then the latter added to the former. Also, the alcohol can be added as a solution in water or it can be added separately, either to the gasoline phase or after the water phase has been dispersed. The preferred method is to blend three solutions simultaneously, namely, 1. lead-free gasoline or similar hydrocarbon fuel;
2. solution of surface-active agents; and
3. water or a solution of a water-soluble alcohol in water.

The following examples are provided simply to illustrate the embodiments of our invention and are not intended to limit it in any way.

EXAMPLE 1

A stock solution was prepared by mixing 1,000 ml. of NP-14, 1,000 ml. of NP-27, 900 ml. of oleic acid, and 100 ml. of concentrated ammonium hydroxide solution. The ammonium hydroxide solution contained 29.9% $NH_3$ and had a density of 0.89 gm/ml. The NP-14 and the NP-27 are polyoxyethylene alkyl phenol-type surface-active agents obtained from Union Carbide Corporation. They were found to have respective densities of 1.03 and 1.06 gm/ml.

The stock solution, therefore, contained the following:

| | |
|---|---|
| 1,030 | grams NP-14 |
| 1,060 | grams NP-27 |
| 468 | grams ammonium oleate |
| 363 | grams free oleic acid |
| 62 | grams water |
| 2.983 | grams total |

This solution was viscous, colorless, and clear at room temperature. It had a density of 0.98 gm/ml.

The stock solution, labeled E-019, was used to prepare the following liquid fuel formulations:

| | E-019 ml | Water ml | Methanol ml | Unleaded gasoline ml |
|---|---|---|---|---|
| Formulation A | 25 | 5 | 15 | 340 |
| Formulation B | 25 | 10 | 10 | 340 |

In preparing each formulation, the water and methanol were first added to E-019, resulting in a clear solution. Unleaded gasoline was added to this clear solution, resulting in a clear, single-phase liquid.

Both of the liquid fuel compositions were refrigerated at −20° C. overnight. They were then examined and found to still be clear and in a single phase. The samples were removed, brought to room temperature, and then immersed in warm water. They still remained clear and in a single phase. In other words, there was no phase separation or reduction in clarity by subjecting the samples to extreme temperature differences.

The calculated weight percentages of the constituents of the above formulations are as follows:

| | Formulation A | Formulation B |
|---|---|---|
| Non-leaded gasoline, % | 85.60 | 85.25 |
| NP-14, % | 2.96 | 2.95 |
| NP-27, % | 3.04 | 3.04 |
| Ammonium oleate, % | 1.34 | 1.34 |
| Free oleic acid, % | 1.03 | 1.04 |
| Water, % | 1.93 | 3.66 |
| Methanol, % | 4.10 | 2.72 |

EXAMPLE 2

Formulation A of Example 1 was kept the same except that the 15 ml. of methanol were replaced by 15 ml. of ethanol. There resulted a clear, single-phase liquid. This liquid was also refrigerated at −20° C. overnight. It was examined and found to still be clear. The clarity and single phase remained the same when the liquid fuel was warmed.

EXAMPLE 3

Formulation A of Example 1 was kept the same except that the 15 ml. of methanol were replaced by 15 ml. of isopropanol. There resulted a clear, single-phase liquid. It also maintained the same clarity and single phase after subjection to −20° C. overnight and then followed by warming.

EXAMPLE 4

A solution was prepared from 90 ml. of oleic acid, 15 ml. of concentrated ammonium hydroxide (29.9% $NH_3$ and density of 0.89 gm/ml.), and 100 ml. of Span 80 (an ester of a polyol and long-chain fatty acid).

Ten ml. of water and 10 ml. of methanol were added to 25 ml. of this solution. There resulted a clear solution to which were added 340 ml. of unleaded gasoline. A clear, single-phase liquid was obtained having a low viscosity, such as those fuel compositions described in Examples 1 to 3. It also maintained the same clarity and single phase after subjection to −20° C. overnight and then followed by warming.

EXAMPLE 5

One gram of sodium hydroxide in 5 ml. of water was added to 100 ml. of the stock solution labeled E-019, described in Example 1. This was sufficient sodium hydroxide to neutralize about 59% of the free oleic acid so that the molar percent ratio of ammonium oleate to sodium oleate in the resulting solution was about 67 to 33. When the sodium oleate first formed, it precipitated out but then quickly dissolved, resulting in a clear solution.

Ten ml. of methanol were added to 80 ml. of low-lead gasoline. Phase separation occurred. Then, 10 ml. of the above solution were added, and the contents lightly stirred. There resulted a single-phase, clear, low viscosity liquid. This liquid was placed in a freezer at −20° C. overnight. The fuel composition was still clear and in a single phase at this low temperature.

EXAMPLE 6

Performance tests were conducted at a commercial laboratory which was fully equipped to follow the 1973 Federal Test Procedure for constant volume sampling of exhaust gases.

The test vehicle was a 1973 Plymouth Fury III (A Chrysler Corporation product).

Vehicle specifications were as follows:

| | |
|---|---|
| Displacement | 360 cubic inches |
| A/F ratio | 15.5:1 |
| Compression ratio | 8.5:1 |

The vehicle was equipped with government specified emission control devices, i.e., exhaust gas recirculation and positive crankcase ventilation.

The base fuel was a 91 octane low-lead gasoline blend. The stock solution, E-019, of Example 1 was used to prepare two clear liquid fuel compositions comprising the following weight percentages:

| | Fuel Composition A | Fuel Composition B |
|---|---|---|
| Percent water | 2.5 | 0.5 |
| Percent methanol | 2.5 | 7.5 |
| Percent E-019 | 6.9 | 10.5 |
| Percent base fuel | 88.1 | 81.5 |

The base fuel and fuel composition A were tested in the above engine. The exhaust emissions in grams/mile were as follows:

| | Exhaust Emissions In Grams/Mile | |
|---|---|---|
| | Base Fuel | Fuel Composition A |
| HC | 3.7 | 3.2 |
| CO | 36.0 | 18.7 |
| $NO_x$ | 4.7 | 3.1 |
| Total | 44.4 | 25.0 |

These data show a 44% reduction in total exhaust emissions using fuel composition A compared to the base fuel. Furthermore, the research octane number increased from 93.2 to 95.2 in going from the base fuel to fuel composition A.

The base fuel was then compared with fuel composition B, giving the following test results:

| | Exhaust Emissions In Grams/Mile | |
|---|---|---|
| | Base Fuel | Fuel Composition B |
| HC | 2.73 | 2.70 |
| CO | 50.46 | 26.26 |
| $NO_x$ | 3.10 | 2.83 |
| Total | 56.29 | 31.79 |

These data also show about a 44% reduction in total exhaust emissions using fuel composition B compared to the base fuel. Performance through cold starts and accelerations was found equally good for fuel composition B compared to the base fuel.

EXAMPLE 7

The following solutions or mixtures were blended:

a. 160 ml. of lead-free gasoline;

b. a mixture of 5 ml. of NP-14 and 5 ml. of NP-27 (non-ionic surfactants of the polyoxyethylene alkyl phenol-type obtained from Union Carbide Corporation), and 5 ml. of a solution of ammonium oleate in oleic acid in which the concentration of ammonium oleate was about 50%; and c. a solution of 5 ml. of water and 5 ml. of ethyl alcohol.

When (b) was added to (a), a clear solution resulted. When (c) was added and the contents mixed gently, a W/O emulsion resulted. When a beam of light was passed through the W/O emulsion fuel held in a dark room, we observed the Brownian Motion of colloidal particles within the shaft of light, confirming the Tyndall effect of the liquid-to-liquid colloidal emulsion.

The composition was placed in a refrigerator and cooled to about −12° F. The cold emulsion remained clear and still exhibited the characteristic Tyndall effect.

EXAMPLE 8

The same formulation as in Example 7 except that the ethanol was replaced with methanol. A stable composition resulted as in Example 7.

EXAMPLE 9

The same formulation as in Example 7 except that the ethanol was replaced with isopropanol. A stable composition resulted as in Example 7.

While certain representative embodiments and details have been shown for the purpose of illustrating the invention, it will be apparent to those skilled in the art that various changes and modifications may be made therein without departing from the scope of the invention as defined by the appended claims.

We claim:

1. A clear, liquid composition stable below the freezing point of water and suitable for use as a fuel in an internal combustion engine, which comprises:

a. a hydrocarbon fuel suitable for use in an internal combustion engine;

b. about 0.1% to about 10% water;

c. about 0.1% to about 20% of an alcohol which is completely soluble in water; and d. a surface active amount of a combination of surface-active agents consisting of:

i. a mixture of ammonium and sodium oleate;

ii. an organic acid selected from the group consisting of oleic, linoleic, stearic acids, and mixtures thereof; and iii. an ethylene oxide condensation product.

2. A composition according to claim 1 which comprises a hydrocarbon fuel suitable for use in an internal combustion engine, 0.5 to 5% water, 1 to 10% of a water-soluble alcohol selected from the group consisting of methanol, ethanol, isopropanol or mixtures thereof, and a surface-active amount of a mixture of ammonium and sodium oleate, free oleic acid, and a condensation product of an alkyl phenol and ethylene oxide.

3. A fuel composition, according to claim 1, wherein the hydrocarbon fuel is gasoline.

4. A fuel composition, according to claim 1, wherein the molar ratio of the ammonium to the sodium oleate ranges from 95:5 to 50:50.

5. A fuel composition, according to claim 1, wherein the ratio of the ethylene oxide condensation product to the mixture of ammonium and sodium oleate salt ranges from 1:1 to 1:3 by weight.

6. A composition according to claim 1, wherein the ethylene oxide condensation product is formed with (i) an alkyl phenol of the formula:

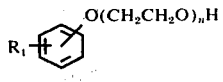

wherein $R_1$ is alkyl having up to 8 carbon atoms and n is an integer from 5 to 20;

ii. a fatty acid of the formula:

$$R_2-\underset{\underset{O}{\|}}{C}-(O-CH_2-CH_2)_nOH$$

iii. a fatty alcohol of the formula:

$$R_2-(O-CH_2-CH_2)_nOH$$

wherein $R_2$ is stearyl, cetyl, lauryl, oleyl, or linoleyl and n is an integer from 5 to 20; or iv. a polyol having the formula:

$$HOCH_2-(CHOH)_n-CH_2O\underset{\underset{O}{\|}}{C}-R_3$$

wherein $R_3$ is a stearyl, cetyl, lauryl, oleyl or linoleyl and n is an integer from 1 to 4.

* * * * *

UNITED STATES PATENT OFFICE

CERTIFICATE OF CORRECTION

Patent No. 4,002,435 Dated January 11, 1977

Inventor(s) Edward C. Wenzel et al.

It is certified that error appears in the above-identified patent and that said Letters Patent are hereby corrected as shown below:

Col. 4, line 23, after "mixture of" insert --water, a water-soluble alcohol, and the mixture of--; Col. 4, line 34, "profiled" should read --profile--; Col. 4, line 64, start new paragraph with "The presence of"; Col. 5, line 3, "alkaline" should read --preferred--; Col. 5, line 4, "alkalne" should read --alkaline--; Col. 6, lines 53 and 54, change "340" to --155--; Col. 7, line 6, col. A, change "85.60" to --73.50--; Col. 7, line 6, col. B, change "85.25" to --73.00--; Col. 7, line 7, col. A, change "2.96" to --5.43--; Col. 7, line 7, col. B, change "2.95" to --5.39--; Col. 7, line 8, col. A, change "3.04" to --5.59--; Col. 7, line 8, col. B, change "3.04" to --5.55--; Col. 7, line 9, col. A, change "1.34" to --2.46--; Col. 7, line 9, col. B, change "1.34" to --2.45--; Col. 7, line 10, col. A, change "1.03" to --1.91--; Col. 7, line 10, col. B, change "1.04" to --1.90--; Col. 7, line 11, col. A, change "1.93" to --3.54--; Col. 7, line 11, col. B, change "3.66" to --6.70--; Col. 7, line 12, col. A, change "4.10" to --7.57--; Col. 7, line 12, col. B, change "2.72" to --5.01--; Col. 7, line 39, change "340" to --155--; Col. 10, line 15, delete "salt".

Signed and Sealed this

Twenty-first Day of June 1977

[SEAL]

*Attest:*

RUTH C. MASON
*Attesting Officer*

C. MARSHALL DANN
*Commissioner of Patents and Trademarks*